US007391323B2

(12) United States Patent
Hoshina

(10) Patent No.: US 7,391,323 B2
(45) Date of Patent: Jun. 24, 2008

(54) CONTACTLESS DATA COMMUNICATION SYSTEM, AND CONTACTLESS IDENTIFICATION TAG

(75) Inventor: Masaki Hoshina, Suwa (JP)

(73) Assignee: Seiko Epson Corporation (JP)

( * ) Notice: Subject to any disclaimer, the term of this patent is extended or adjusted under 35 U.S.C. 154(b) by 460 days.

(21) Appl. No.: 11/001,502

(22) Filed: Dec. 1, 2004

(65) Prior Publication Data

US 2005/0128084 A1 Jun. 16, 2005

(30) Foreign Application Priority Data

Dec. 2, 2003 (JP) ..... 2003-403001

(51) Int. Cl.
*G08B 13/14* (2006.01)

(52) U.S. Cl. ..... 340/572.1; 235/382.5

(58) Field of Classification Search ..... 340/572.1, 340/572.4, 505, 10.1, 10.4, 10.51; 235/382.5, 235/382, 492
See application file for complete search history.

(56) References Cited

U.S. PATENT DOCUMENTS 5,508,684 A * 4/1996 Becker ..... 340/572.5
2002/0036237 A1* 3/2002 Atherton et al. ..... 235/492
2002/0084904 A1* 7/2002 De La Huerga ..... 340/573.1
2002/0188259 A1 12/2002 Hickle et al.
2003/0075608 A1* 4/2003 Atherton ..... 235/492

FOREIGN PATENT DOCUMENTS

| | | |
|---|---|---|
| JP | 07-20650 | 4/1995 |
| JP | 2000-90224 | 3/2000 |
| JP | 2000-293648 | 10/2000 |
| JP | 2002-150248 | 5/2002 |
| JP | 2002-150249 | 5/2002 |
| JP | 2002-342734 | 11/2002 |
| JP | 2003-132326 | 5/2003 |
| WO | 02/095675 | 11/2002 |

OTHER PUBLICATIONS

Communication from Japanese Patent Office regarding corresponding application.

* cited by examiner

*Primary Examiner*—Thomas J Mullen, Jr.
*Assistant Examiner*—Anthony J. Williams
(74) *Attorney, Agent, or Firm*—Harness, Dickey & Pierce, P.L.C.

(57) ABSTRACT

As a contactless identification tag is removed from a commercial product, a section to be detected is cut and separated from a removal detection circuit section composing the contactless identification tag and remains on the commercial product. When a detection section judges that the section to be detected is removed from the contactless identification tag, the contactless identification tag changes functions.

12 Claims, 9 Drawing Sheets

CONTACTLESS DATA COMMUNICATION SYSTEM, AND CONTACTLESS IDENTIFICATION TAG

RELATED APPLICATIONS

This application claims priority to Japanese Patent Application No. 2003-403001 filed Dec. 2, 2003 which is hereby expressly incorporated by reference herein in its entirety.

BACKGROUND

1. Technical Field

The present invention relates to data communications using contactless identification tags, and contactless communication systems and contactless identification tags which assure security and easy maintenance of contactless identification tags.

2. Related Art

In recent years, various types of contactless IC tags in a sheet configuration or a tag configuration, in which an IC having data is connected to an antenna coil, have been proposed, and they are used, being attached to commercial products, packing boxes or the like to defend them from shoplifting, and used in commercial distribution systems.

Conventionally, systems that use contactless IC tags to detect impacts have been proposed. For example, there is a system that detects that an impact is applied to a package (see Japanese Laid-open Patent Application 2002-150249), wherein an IC tag having an impact sensor (Japanese Laid-open Patent Application 2002-150248) is attached to the package, the impact sensor breaks and its voltage changes when an impact greater than a predetermined level is applied to the IC tag, and a change in the voltage is detected.

However, although the conventional IC tag described above can detect the presence or absence of an impact, it cannot detect the presence or absence of unauthorized access. Further, it cannot prevent data reading or writing through unauthorized access.

A contactless IC tag may have functions, for example, to read an ID (identification) number written in the IC tag, and to write data in a nonvolatile memory in the IC tag. To operate such functions, in general, commands from a reader/writer device are executed. Accordingly, writing data in or reading data from the IC tag can be done if a reader/writer device that can access the IC tag is prepared.

As a result, for example, if stored data includes purchase history and sales history including private personal information and important client information, it is possible that they can be accessed without being noticed by the owner of the IC tag, and the data may be falsified. Even when commands not open to the public are used as commands from a reader/writer device to execute data reading or writing, an analyzer device may be used to analyze communications between the IC tag and the reader/writer device, whereby a method to access the IC tag can be discovered. This poses a serious problem.

Also, data may be encoded to prevent unauthorized access. However, when IC tags are collected and maintained in the factory, there is a possibility that troublesome operations such as decoding (release) may be needed if an access method is encoded.

Accordingly, the present invention has been made by paying attention to the unsolved problems of the conventional technology, and its object is to provide contactless data communication systems and contactless identification tags which can enhance the security against accesses to the contactless identification tags, and facilitate accesses at the time of maintenance.

SUMMARY

A contactless data communication system in accordance with the present invention pertains to a contactless data communication system including a reader/writer device and a contactless identification tag, characterized in that: the reader/writer device is equipped with a data communication section that is capable of data communications with the contactless identification tag, and an electromagnetic wave transmission section for supplying power that transmits an electromagnetic wave for supplying power to the contactless identification tag at the time of data communications by the data communication section, and the contactless identification tag is equipped with a driving power generation section that generates a driving power from the electromagnetic wave for supplying power transmitted from the reader/writer device, a section to be detected provided at a portion of the contactless identification tag, a detection section that detects a change occurred at the section to be detected, and a function changing section that changes functions of the contactless identification tag when the detection section detects that a change occurs in the section to be detected.

In this manner, the detection section of the contactless identification tag makes a detection when a change occurs in the section to be detected. Then, when a change occurs in the section to be detected of the contactless identification tag, the function changing section of the contactless identification tag changes its function. Accordingly, the security of the contactless identification tag is enhanced, and accesses at the time of maintenance can be facilitated.

The contactless data communication system is characterized in that the detection section is equipped with a voltage monitoring circuit that is capable of monitoring voltage, wherein a wiring of a circuit composing the contactless identification tag is connected to the voltage monitoring circuit, and the wiring is cut when a change occurs in the section to be detected of the contactless identification tag, and detects a voltage value that changes as a result of the wiring being cut.

In this manner, the wiring composing the contactless identification tag breaks when a change occurs in the section to be detected. Accordingly, by comparing a voltage value before the line breakage and a voltage value after the line breakage, the state of the section to be detected of the contactless identification tag can be found.

The contactless data communication system is characterized in that the contactless identification tag is equipped with a mounting section that is capable of mounting the contactless identification tag to a specified object, and the detection section is composed such that the section to be detected is removed off the contactless identification tag when the contactless identification tag is removed from the specified object, and makes a detection when the section to be detected is removed from the contactless identification tag.

In this manner, the contactless identification tag is attached to a specified object by the mounting section. The detection section detects if the contactless identification tag is removed from the specified object. Therefore, the security of the contactless identification tag that is removed from the specified object can be enhanced.

The contactless data communication system is characterized in that the function changing section is equipped with a function restriction section that restricts the function of the contactless identification tag.

In this manner, because the contactless identification tag is provided with the function restriction section that restricts its function, its function can be restricted when a change occurs in the detection section of the contactless identification tag. Accordingly, the security of the contactless identification tag can be enhanced.

The contactless data communication system is characterized in that the function restriction section stops responses from the contactless identification tag to the reader/writer device.

In this manner, the function restriction section makes the contactless identification tag possible not to return information even when a reader/writer device accesses the contactless identification tag. Accordingly, the security of the contactless identification tag can be enhanced.

The contactless data communication system is characterized in that the function restriction section restricts a range of the functions that can be executed by a command from the reader/writer device.

In this manner, the function restriction section of the contactless identification tag restricts the functions by a command from the reader/writer device. Accordingly, the security of the contactless identification tag can be enhanced according to a command that restricts the functions.

The contactless data communication system is characterized in that the contactless identification tag is equipped with a storage section that stores contents of access communication from the reader/writer device when the functions are restricted.

In this manner, the contactless identification tag stores in the storage section information accessed and transferred from the reader/writer device to the contactless identification tag when the functions are restricted. Accordingly, even when a reader/writer device gains an illegal access to the contactless identification tag, the state can be confirmed based on access information stored.

The contactless data communication system is characterized in that the contactless identification tag is equipped with a display section that displays an access communication content from the reader/writer device when the functions are restricted.

In this manner, the contactless identification tag displays on the display section access record representing an access made from a reader/writer device when the function is restricted. Accordingly, when a reader/writer device gains an illegal access, the state of the contactless identification tag can be readily visually determined by looking at the display section.

The contactless data communication system is characterized in that the display section is equipped with a display device having a memory property.

In this manner, the display section of the contactless identification tag displays with the display device that has a memory property. Accordingly, information that is once displayed can be retained without consuming electrical power, and the displayed information can be continuously displayed. Accordingly, the state of the contactless identification tag can be visually confirmed even when electrical power is not supplied.

The contactless data communication system is characterized in that the function changing section is equipped with a function adding section that adds functions to the contactless identification tag.

In this manner, the contactless identification tag can add by the function adding section a function to the contactless identification tag. Accordingly, when a change occurs in the section to be detected of the contactless identification tag, a function can be added, such that access to the contactless identification tag is facilitated at the time of maintenance.

A contactless identification tag in accordance with the present invention is characterized in comprising: a driving power generation section that generates a driving power from an electromagnetic wave for power supply transmitted from the reader/writer device, a section to be detected provided at a portion of the contactless identification tag, a detection section that detects a change occurred at the section to be detected, and a function changing section that changes a function of the contactless identification tag when the detection section detects that a change occurs in the section to be detected.

In this manner, the detection section of the contactless identification tag detects if a change occurs in the section to be detected. When a change occurs in the section to be detected of the contactless identification tag, the function is changed by the function changing section of the contactless identification tag. Accordingly, the security of the contactless identification tag is enhanced and access at the time of maintenance can be facilitated.

The contactless identification tag is characterized in that the detection section is equipped with a voltage monitoring circuit that is capable of monitoring voltage, wherein a wiring of a circuit composing the contactless identification tag is connected to the voltage monitoring circuit, and the wiring is cut when a change occurs in the section to be detected of the contactless identification tag, and detects a voltage value that changes by the cut of the wiring.

In this manner, the wiring composing the contactless identification tag breaks when a change occurs in the section to be detected. Accordingly, by comparing a voltage value before the line breakage and a voltage value after the line breakage, the state of the section to be detected of the contactless identification tag can be found.

The contactless identification tag is characterized in that the contactless identification tag is equipped with a mounting section that is capable of mounting the contactless identification tag to a specified object, and the detection section is composed such that the section to be detected is removed off the contactless identification tag when the contactless identification tag is removed from the specified object, and detects if the section to be detected is removed from the contactless identification tag.

In this manner, the contactless identification tag is attached to a specified object by the mounting section. The detection section detects if the contactless identification tag is removed from the specified object. Therefore, the security of the contactless identification tag that is removed from the specified object can be enhanced.

The contactless identification tag is characterized in that the function changing section is equipped with a function restriction section that restricts the functions of the contactless identification tag.

In this manner, because the contactless identification tag is provided with the function restriction section that restricts its functions, its functions can be restricted when a change occurs in the detection section of the contactless identification tag. Accordingly, the security of the contactless identification tag can be enhanced.

The contactless identification tag characterized in that the function restriction section stops responses from the contactless identification tag to the reader/writer device.

In this manner, the function restriction section makes the contactless identification tag possible not to return information even when a reader/writer device accesses the contactless identification tag. Accordingly, the security of the contactless identification tag can be enhanced.

The contactless identification tag is characterized in that the function restriction section restricts a range of the functions that can be executed by commands from the reader/writer device.

In this manner, the function restriction section of the contactless identification tag restricts the functions by a command from the reader/writer device. Accordingly, the security of the contactless identification tag can be enhanced according to a command that restricts the function.

The contactless identification tag is characterized in that the contactless identification tag is equipped with a storage section that stores contents of access communication sent from the reader/writer device when the functions are restricted.

In this manner, the contactless identification tag stores in the storage section information accessed and transferred from the reader/writer device to the contactless identification tag when the functions are restricted. Accordingly, even when a reader/writer device gains an illegal access to the contactless identification tag, the state can be confirmed based on the access information stored.

The contactless identification tag is characterized in that the contactless identification tag is equipped with a display section that displays contents of access communication sent from the reader/writer device when the functions are restricted.

In this manner, the contactless identification tag displays on the display section access record representing accesses made from a reader/writer device when the functions are restricted. Accordingly, when a reader/writer device gains an unauthorized access, the state of the contactless identification tag can be readily visually determined by looking at the display section.

The contactless identification tag is characterized in that the display section is equipped with a display device having a memory property.

In this manner, the display section of the contactless identification tag displays with the display device that has a memory property. Accordingly, information that is once displayed can be retained without consuming electrical power, and the displayed information can be continuously displayed. Accordingly, the state of the contactless identification tag can be visually confirmed even when electrical power is not supplied.

The contactless identification tag is characterized in that the function changing section is equipped with a function adding section that adds functions to the contactless identification tag.

In this manner, the contactless identification tag can add by the function adding section a function to the contactless identification tag. Accordingly, when a change occurs in the section to be detected of the contactless identification tag, a function can be added, such that access to the contactless identification tag is facilitated at the time of maintenance.

DETAILED DESCRIPTION

First Embodiment

A first embodiment of the present invention is described below with reference to FIG. 1-FIG. 7. Also, in the present embodiment, a contactless data communication system is described with reference to an example in which contactless identification tags are used, being attached to commercial products as specified objects sold in stores.

Figure 1:
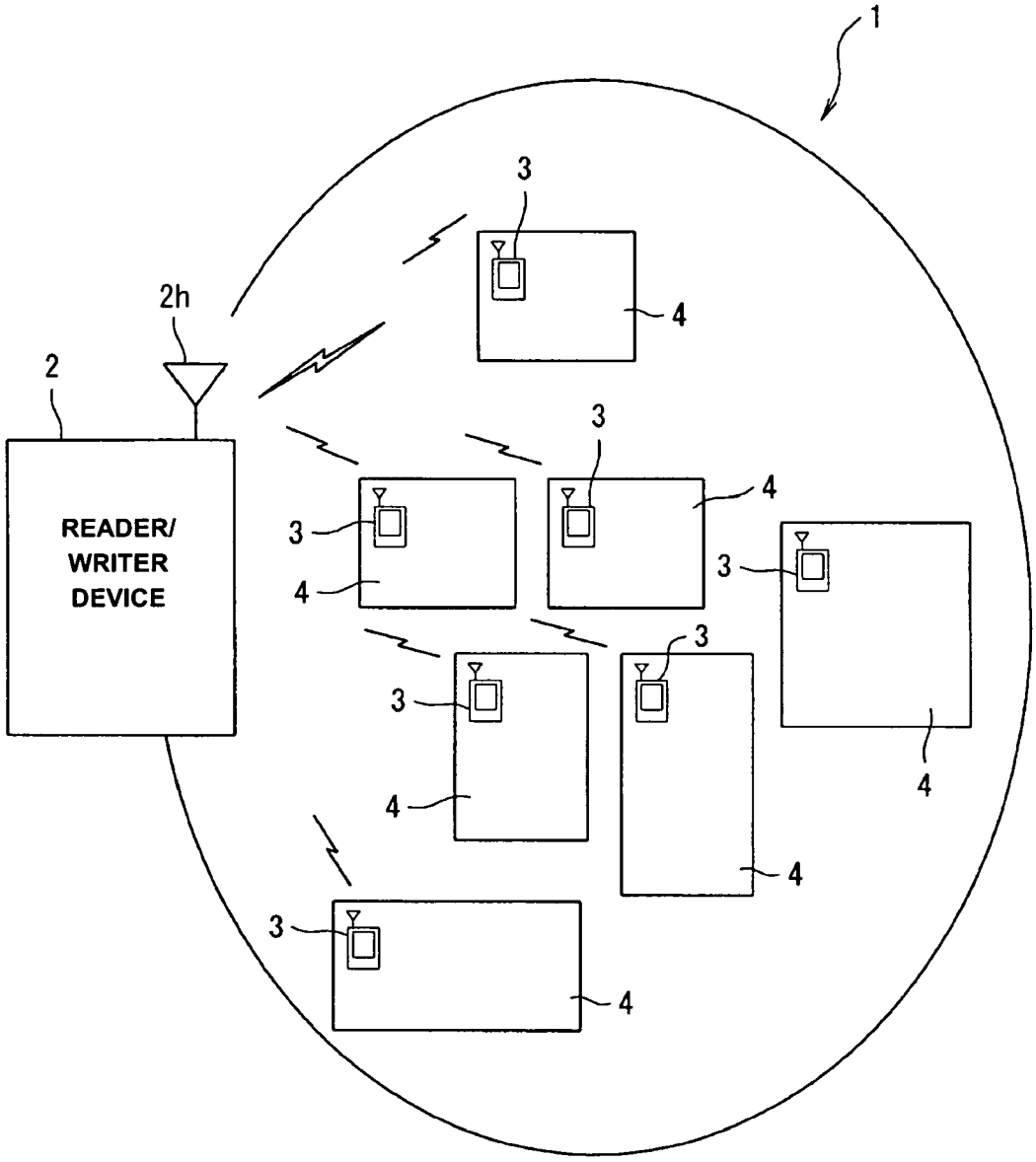
FIG. 1 is a block diagram indicating a structure of a contactless data communication system in accordance with a first embodiment of the present invention.

FIG. 1 shows a block diagram indicating a structure of a contactless data communication system in accordance with the present invention.

As shown in FIG. 1, the contactless data communication system 1 has a structure including a reader/writer device 2, and a plurality of contactless identification tags 3.

The reader/writer device 2 writes management information of commercial products in the contactless identification tags 3 attached to commercial products 4 as specified objects, read management information written in the contactless identification tags 3 and display the same on a display section 2*g*, and displays information transmitted from the contactless identification tags 3 on the display section 2*g*. Also, the reader/writer device 2 is equipped with an antenna 2*h* for communicating data with the contactless identification tags 3.

The contactless identification tag 3 is equipped with a mounting section for attaching itself to the commercial products 4. Furthermore, the contactless identification tags 3 are correlated one to one to the corresponding commercial products 4, perform contactless data communication with the reader/writer device 2 using identification ID numbers to manage the commercial products 4. Also, the contactless identification tags 3 are equipped with removal detection sections 35 (see FIG. 3) for detecting if they themselves are removed from the commercial products 4. It is noted that each of the identification ID numbers is unique to each of the contactless identification tags 3, and stored in a data storage section 33 (see FIG. 3) that is a storage section to be described later of the contactless identification tag 3.

It is noted here that the contactless identification tags 3 are also generally called data carriers, which are used in an RFID (Radio Frequency IDentification) system. They can be in a variety of configurations, such as, a label shape, card shape, coin shape, stick shape or the like. These configurations have close relation to their applications. For example, those carried by people may be in a key holder shape that is modified from a card shape or a label shape. Also, those used as carrier IDs for semiconductor devices are predominantly in a stick shape. Also, those that are sewed to clothes of linen are predominantly in a coin shape.

Also, the contactless identification tag 3 is equipped with a storage region that is dedicated for reading data, or where data can be freely read and written, and can be operated by contactless power transmission from the antenna 2*h* (see FIG. 2) without a battery.

Also, the RFID system is an ID system that uses radio wave or electromagnetic wave as a medium, in which the contactless identification tag 3 has three characteristics: (1) it has the size that is readily carried, (2) it stores information in an electronic circuit, and (3) it communicates in a contactless communication.

Accordingly, the RFID system is used for the purpose of unifying people, items, vehicles and the like carrying contactless identification tags with their information. In other words, where there are people, items and vehicles, required information can be retrieved from the contactless identification tags 3 at any time, and new information can be written as necessary in the contactless identification tags 3.

Also, there are four representative kinds of the RFID system, i.e., an inductive coupling system, an electromagnetic induction system, a microwave system, and an optical system.

The inductive coupling system communicates with the contactless identification tags 3, primarily using mutual induction of coils by alternating magnetic field.

The electromagnetic induction system communicates with the contactless identification tags 3, primarily using electromagnetic wave in a long or medium wavelength range that is a 250 kHz or below, or a 13.56 MHz band.

The microwave system performs data communications between the antenna 2*h* (see FIG. 2) of the reader/writer device 2 and the contactless identification tags with microwave in a 2.45 GHz band.

The optical system is provided with an LED as a light generation source and a phototransistor or the like as a photodetector to communicate with the contactless identification tags 3 using spatial transmission of light.

Also, there are mainly four access modes, including a single access mode, a FIFO (First In First Out) access mode, a multiple access mode, and a selective access mode.

In the single access mode, one contactless identification tag 3 can be present in an antenna communication range, and no communication can be established as a communication error occurs if multiple contactless identification tags 3 are present in the antenna communication range.

In the FIFO access mode, communications can be established sequentially with contactless identification tags 3 in the order that they enter an antenna communication range. An access prohibiting process is conducted on those of the contactless identification tags 3 when they complete communications. Accordingly, even when multiple contactless identification tags 3 that have completed communications are present within the antenna communication range, communications can be established with a new contactless identification tag 3 that enters the antenna communication range. If multiple contactless identification tags 3 simultaneously enter the communication range, a communication error takes place, and communications cannot be established.

In the multiple access mode, even when multiple contactless identification tags 3 are present in an antenna communication range, communications can be established with all of the contactless identification tags 3.

In the selective access mode, among multiple contactless identification tags 3 that are present in a communication range, communications can be established with specified ones of the contactless identification tags 3, which is realized by a command for allocating numbers to the contactless identification tags 3 within the communication range, and a command for establishing communications with specified ones of the contactless identification tags 3 based on the allocated numbers.

The commercial products 4 may be goods that are handled in stores or the like, and the contactless identification tag 3 is attached to each of them.

Figure 2:
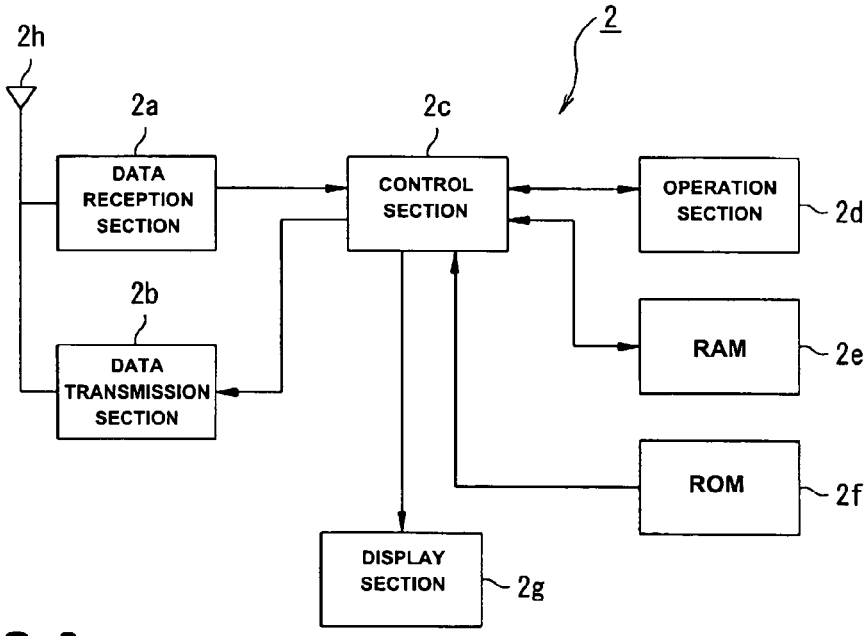
FIG. 2 is a block diagram indicating a structure of a reader/writer device.

FIG. 2 is a block diagram showing a structure of the reader/writer device 2.

As shown in FIG. 2, the reader/writer device 2 has a structure including a data reception section 2*a*, a data transmission section 2*b*, a control section 2*c*, an operation section 2*d*, a RAM (Random Access Memory) 2*e*, a ROM (Read Only Memory) 2*f*, a display section 2*g*, and an antenna 2*h*.

The data reception section 2*a* receives information from the contactless identification tag 3 in a contactless manner. By this, the data reception section 2*a* can obtain management information or the like concerning the commercial products 4.

The data transmission section 2*b*, that is an electromagnetic wave transmission section for power supply, transmits commands for reading information, such as, management information stored in the contactless identification tags 3, management information for correlating the contactless identification tags 3 and commercial products, and the like to the contactless identification tags 3 in a contactless manner. In the present embodiment, carrier waves used at the time of data communications are used for supplying electrical power to the contactless identification tags 3.

It is noted here that an electromagnetic induction system that performs communications, primarily using electromagnetic wave in a long or medium wavelength range that is a 250 kHz or below, or a 13.56 MHz band is used for communications between the reader/writer device 2 and the contactless identification tags 3 in accordance with the present embodiment. Also, data communications between the reader/writer device 2 and the contactless identification tags 3 use a selective access mode that allows communications with specified contactless identification tags 3 among multiple contactless identification tags 3 that are present in a communication range.

The control section 2*c* executes with a CPU (Central Processing Unit) (not shown) control programs stored in the ROM 2*f*, to thereby control and supervise operations of the reader/writer device 2. Contents of the control programs include controlling of data communication processings by an electromagnetic induction method using the data reception section 2*a* and the data transmission section 2*b*, such as reception of data from the contactless identification tags 3, transmission of data to the contactless identification tags 3, and the like. Further, they also include controlling of processings to change set values that are used at the time of execution of the control program according to contents of operation of the operation section 2*d*, controlling of processing to display on the display section 2*g* predetermined information, such as, information obtained from the contactless identification tags 3, and the like.

The operation section 2*d* is equipped with operation functions of switches and the like for turning on and off the power supply, resetting programs and the like, and sections for setting information contents to be written in the contactless identification tags 3 and the like.

The RAM 2*e* is a memory that temporarily stores data necessary for executing the control programs stored in the ROM 2*f* by the CPU of the control section 2*c*.

The ROM 2*f* is a read only memory that sores the control programs for supervising and controlling the reader/writer device 2.

The display section 2*g* is equipped with a display region such as a liquid crystal display, and is equipped with a function to display information obtained from the contactless identification tags, contents currently set at the reader/writer device 2, execution states of processings, and the like.

The antenna 2*h* is provided for transmitting electromagnetic wave including data from the reader/writer device 2 to the contactless identification tags 3.

Figure 3:
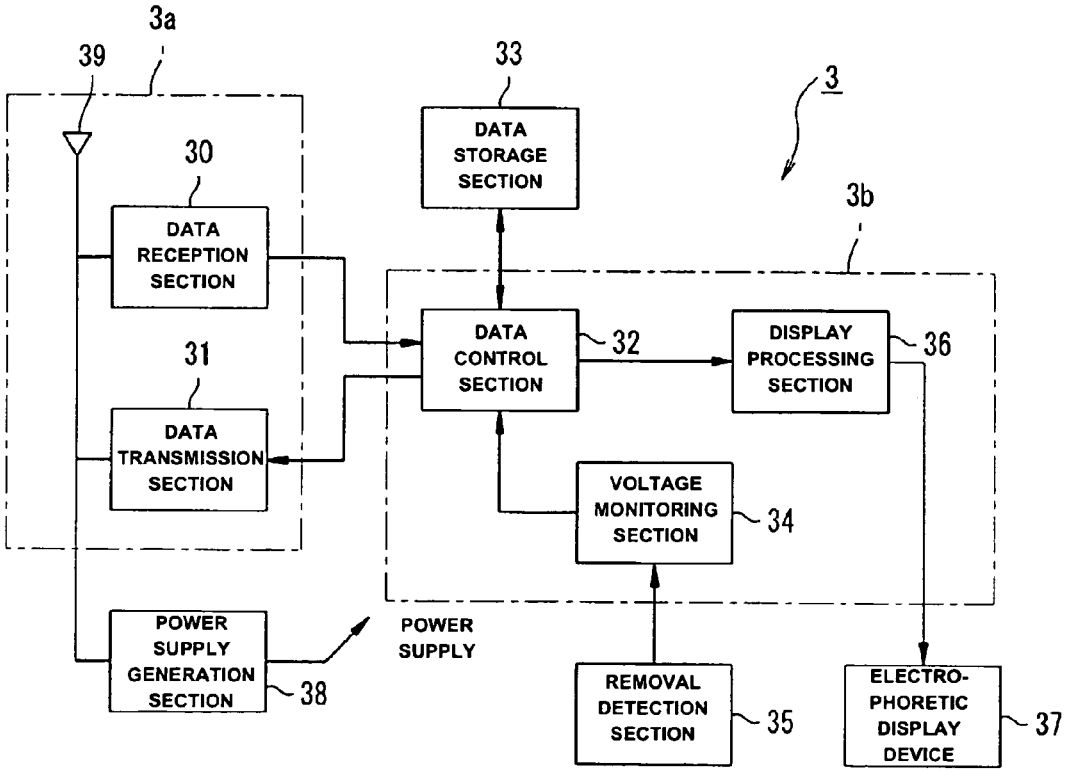
FIG. 3 is a block diagram indicating a structure of a contactless identification tag.

FIG. 3 is a block diagram indicating a composition of the contactless identification tag 3.

As shown in FIG. 3, the contactless identification tag 3 has a structure including a data transmission section 3*a*, a control section 3*b*, a data storage section 33 that is a nonvolatile memory such as a flash memory, a ferroelectric memory (FeRAM) or the like, a removal detection section 35, an electrophoretic display device 37 that is a display device having a memory property, a power supply generation section 38 that is a driving electric power generation section, and a coil antenna 39.

The data communication section 3*a* has a structure including a data reception section 30, a data transmission section 31 and a coil antenna 39.

The data reception section 30 is equipped with a function to receive, by an electromagnetic induction method, data transmitted from the reader/writer device 2.

The data transmission section 31 is equipped with a function to transmit, by an electromagnetic induction method, specified data stored in the data storage section 33 to the reader/writer device 2.

The antennal coil 39 is for receiving, by an electromagnetic induction method, electromagnetic wave including data transmitted from the reader/writer device 2.

The control section 3*b* has a structure including a data control section 32, a voltage monitoring section 34 as a voltage monitoring circuit, and a display processing section 36. The control section 3*b* executes control programs corresponding to these sections by a CPU not shown, to thereby control operations of the respective sections of the contactless identification tag 3. It is noted that, although the functions of the contactless identification tag 3 are changed by the CPU and control programs in accordance with the present embodiment, a structure may be provided to control these operations by a logic circuit, without being limited to the above.

The data control section 32 controls data reception and transmission at the data communication section 3*a*, and controls storage processing on data received.

The voltage monitoring section 34 monitors a voltage value of a specified circuit in the contactless identification tag 3.

The display processing section 36 controls display of specified information on the electrophoretic display device 37 according to commands from the data control section 32.

It is noted here that the electrophoretic phenomenon is the operation principle of an electrophoretic display device. It is a phenomenon in which, when an electric field is applied to a dispersing liquid containing fine particles dispersed in a liquid phase dispersing medium, the particles that are naturally charged through dispersion (electrophoretic particles) migrate by Coulomb's force. The electrophoretic display device has a displayed image retaining property (hereafter referred to as a "memory property"), and is capable of retaining an image that is once displayed by an application of an electric field.

The data storage section 33 is equipped with a function to store, in its own memory, specified data such as management information received from the reader/writer device 2 in response to a command from the data control section 32. It is noted here that the data storage section 33 in the present embodiment also stores the control programs described above. Furthermore, the data storage section 33 stores information concerning accesses from the reader/writer device 2 to the contactless identification tags 3.

The removal detection section 35 is equipped with a mechanism for detecting an incident of removal of the contactless identification tag 3 that is once attached to the commercial product 4, as a change in the voltage value at the voltage monitoring section 34.

The electrophoretic display device 37 is a display device that uses the electrophoretic phenomenon described above. The electrophoretic display device 37 displays contents accessed by the reader/writer device 2. By visually inspecting the access record displayed, consumers can confirm what kind of access was made. In the present embodiment, when the reader/writer device 2 gains an illegal access to the contactless identification tag 3, the electrophoretic display device 37 is made to display a record of the access, which can be visually confirmed. Also, the electrophoretic display device 37 can make a color display.

The power supply generation section 38 generates electric power from electromagnetic wave received from the reader/writer device 2, and supplies the same to the sections described above.

Figure 4:
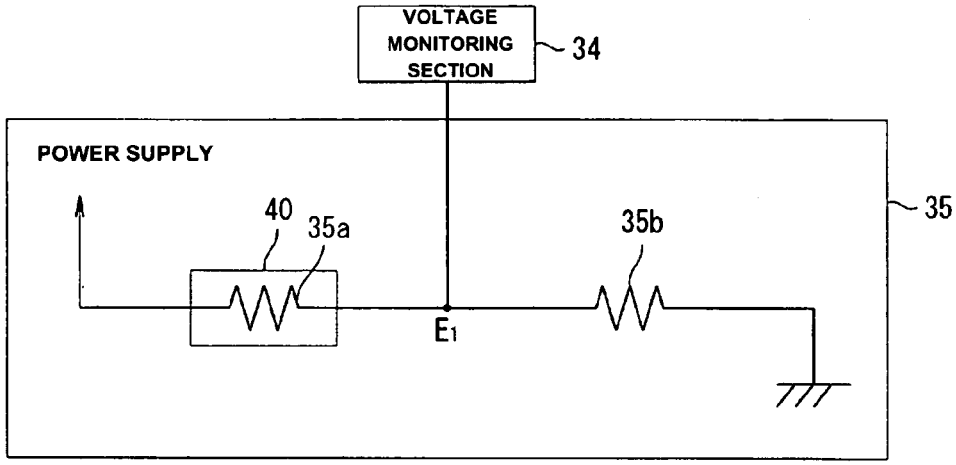
FIG. 4 is a circuit diagram indicating a structure of removal detection by a voltage monitoring section and a detection section.

FIG. 4 is a circuit diagram showing a structure of a detection section composed of the voltage monitoring section 34 and the removal detection section 35.

As shown in FIG. 4, the removal detection section 35 has a structure including a first detection resistance section 35*a* and a second detection resistance section 35*b*. Further, one of wirings of the first detection resistance section 35*a* is connected to a power supply, and the other is connected to the second detection resistance section 35*b*. One of wirings of the second detection resistance section 35*b* is connected to a ground section of the circuit. Then, a wiring extending from a node between the first detection resistance section 35*a* and the second detection resistance section 35*b* is connected to the voltage monitoring section 34. Also, a section to be detected 40 is detachably mounted on the contactless identification tag 3, wherein the first detection resistance section 35*a* is built into the section to be detected 40.

In other words, the voltage monitoring section 34 monitors a voltage value $E_1$ at the node that is voltage-divided by the first detection resistance section 35*a* and the second detection resistance section 35*b*.

Figure 5:
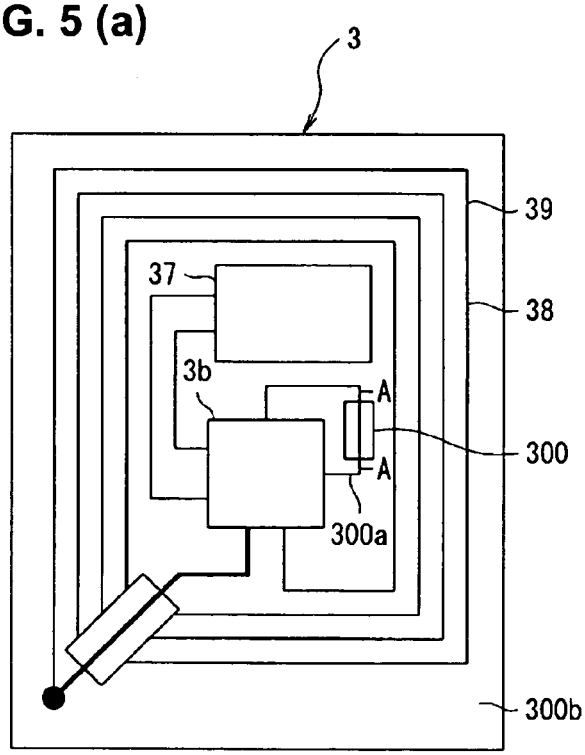
FIG. 5(*a*) is a circuit diagram indicating a circuit structure of a contactless identification tag, and FIG. 5(*b*) is a cross-sectional view taken along a line A-A in FIG. 5(*a*).
Figure 5:
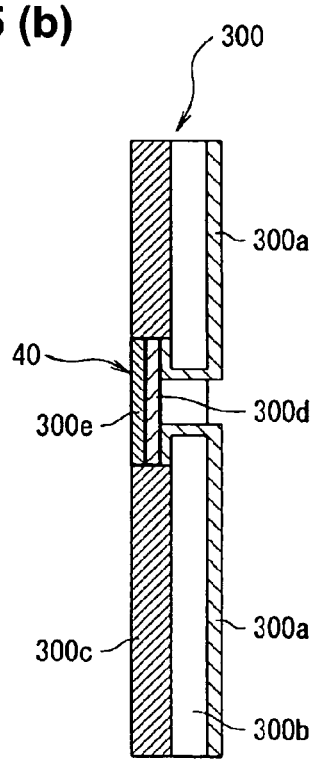

FIG. 5(*a*) is a view showing a circuit structure of the contactless identification tag 3, and FIG. 5(*b*) is a cross-sectional view taken along a line A-A in FIG. 5(*a*).

As shown in FIG. 5(*a*), the circuit structure of the contactless identification tag 3 includes, on a substrate 300*b*, a coil antenna 39 that is formed along the circumference of the substrate 300*b* with a coil of metal drawn in one stroke. It is noted that, in the present embodiment, the coil antenna 39 may be formed by, for example, an ink jet method using metal ink.

On the substrate 300*b*, a control section 3*b* as an IC chip is mounted at its center, and an electrophoretic display device 37 is further mounted. As shown in FIG. 5(*b*), a removal detection circuit section 300 is formed extending from the control section 3*b* through a wiring 300*a*. In the removal detection circuit section 300, a wiring 300*d* of the first detection resistance section 35*a* is formed in a state that can be electrically conductive to the wiring 300*a*, in a manner to contact the wiring 300*a*. Further, an adhesive section 300*c* that is a mounting section for attaching the contactless identification tag 3 to the commercial product 4 is formed on the removal detection circuit section 300.

Further, a paper, a thin film or the like is adhered to the circuit mounted on the substrate 300 for the purpose of protecting it from external dusts and the like.

Figure 6:
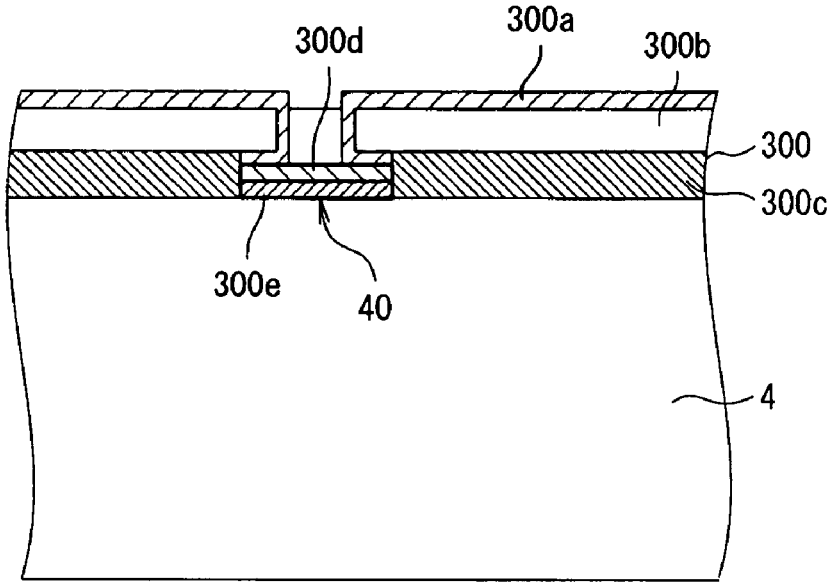
FIG. 6(*a*) is a cross-sectional view taken along a line A-A in FIG. 5(*a*) when a contactless identification tag is attached to a commercial product, and FIG. 6(*b*) is a cross-sectional view indicating a state in which the contactless identification tag is removed from the commercial product from the state shown in the cross-sectional view in FIG. 6(*a*).
Figure 6:
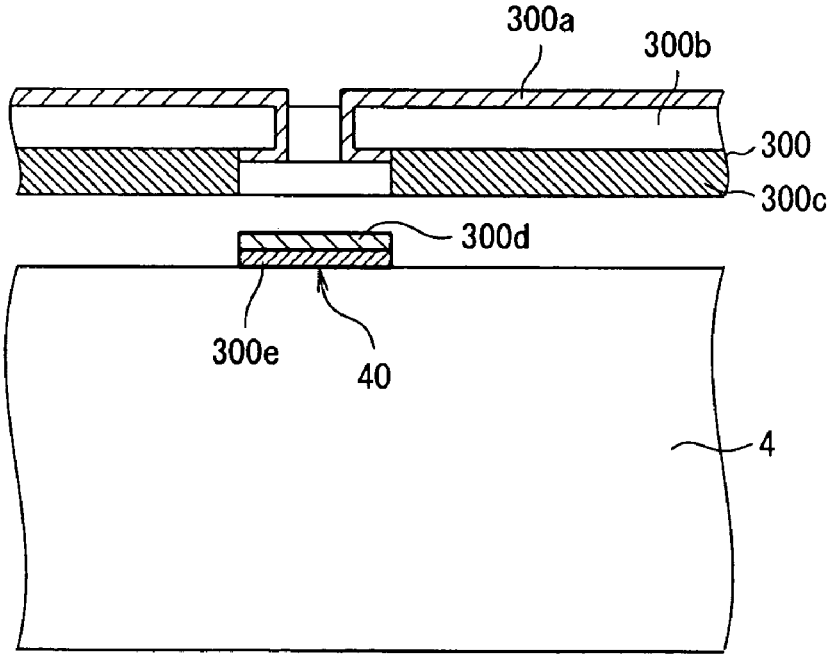

FIG. 6(*a*) is a cross-sectional view taken along a line A-A in FIG. 5(*a*) in which the contactless identification tag 3 is attached to the commercial product 4, and FIG. 6(*b*) is a cross-sectional view indicating a state in which the contactless identification tag 3 is removed from the commercial product 4 from the state shown in the cross-sectional view in FIG. 6(*a*).

As shown in FIG. 6(*a*), the contactless identification tag 3 is attached to the commercial product 4 by the adhesive section 300*c*. In this instance, an adhesive section 300*e* of the section to be detected 40 is formed in a state in which it can be cut off from the other adhesive section 300*c*. Then, as shown in FIG. 6(*b*), when the contactless identification tag 3 is removed from the commercial product 4, because a connecting section of the wiring 300*d* and the wiring 300*a* is formed to connect with a weaker bonding force than the adhesive force of the adhesive section 300*e*, the section to be detected 40 including the first detection resistance section 35*a*, the wiring 300*d* and the adhesive section 300*e* is cut off from the removal detection circuit section 300 composing the contactless identification tag 3, and remains on the commercial product 4.

In this manner, when the contactless identification tag 3 is removed from the commercial product 4, the section to be detected 40 is cut off from the circuit shown in FIG. 4. Accordingly, the voltage that is divided by the first detection resistance section 35*a* and the second detection resistance section 35*b* is not voltage-divided any longer, and therefore the voltage value $E_1$ changes. The change in the voltage value is detected by the voltage monitoring section 34, whereby the incident that the contactless identification tag 3 is removed from the commercial product 4 is detected.

In accordance with the present embodiment, the contactless data communication system 1 of the present invention is applied to the management of commercial products in stores, and the protection of privacy of consumers who purchased commercial products with the contactless identification tags 3 attached thereto, wherein commercial products displayed in stores are managed such that the contactless identification tags 3 would not be illegally removed from the commercial products, or consumers would be prevented from gaining unauthorized access to the contactless identification tags 3 after they have been purchased.

Here, operations of the contactless data communication system 1 are described more concretely.

First, the contactless identification tags 3 are attached to the commercial products 4 in advance. Then, information to be written in the contactless identification tags 3 that are attached to the respective commercial products 4 to be sold is set by the operation section 2*d* of the reader/writer device 2. It is noted here that the information to be set includes kinds of the commercial products, vendors of the commercial products, dates of purchase of the commercial products, and the like. In particular, as private information to be protected, for example, information about the size of clothes and underwear may be enumerated. When these settings are completed, the set information is transmitted to the contactless identification tags 3 having the respective corresponding ID numbers through the data transmission section 2*b*.

When the contactless identification tag 3 receives a response request signal from the reader/writer device 2, a drive power is generated from the carrier wave of the signal by the power supply generation section 38, and distributed to each of the sections of the contactless identification tag 3. By the control of the data control section 32 that is supplied with the electrical power, the data reception section 30 receives the information transmitted from the reader/writer device 2, and the data storage section 33 stores the same in a nonvolatile memory. Further, based on the information stored, the display processing section 36 displays, on the electrophoretic display device 37, the kind of commercial product, the vendor of commercial product, the date of purchase of commercial product and the like in character images, for example. Then, lastly, the contactless identification tag 3 transmits, to the reader/writer device 2, a response signal indicating that a series of the processing steps has been executed through the data transmission section 31. It is noted here that, due to the characteristics of the electrophoretic display device 37, it does not require electrical power to retain the displayed information.

It is noted here that the kinds of commands may include a data write command, a tag response command, a tag response start/stop command, and the like, besides the response request command described above.

The data write command is to write data such as management information or the like in the contactless identification tag 3. In other words, for example, data is transmitted from the reader/writer device 2 to the rewritable nonvolatile memory of the data storage section 33, and the contactless identification tag 3 writes the data therein.

The tag response command is a command for transmitting a serial number of the contactless identification tag 3 to the reader/writer device 2. All of the contactless identification tags 3 that receive this command transmit serial numbers stored in the respective contactless identification tags 3 to the reader/writer device 2. The reader/writer device 2 periodically transmits the tag response command to have the electromagnetic induction circuits of the contactless identification tags 3 generate electrical fields, and receives serial numbers from them, thereby always confirming if there are any approaching contactless identification tags 3. In other words, the contactless identification tags 3 send their serial numbers (or ID numbers for identification) stored in the contactless identification tags 3 to the reader/writer device 2 when the contactless identification tags 3 approach the response range of the reader/writer device 2. The reader/writer device 2 stores the serial numbers to know which contactless identification tags 3 exist in the current response range of the reader/writer device 2.

The tag response start/stop command is a control command for returning or not returning information to the reader/writer device 2. This command is to decide, upon receiving a command transmitted from the reader/writer device 2, as to whether the contactless identification tag 3 should return data to the reader/writer device 2 in response to the command.

When the content of the command is set to a start state, the contactless identification tag 3 returns data in response to the reception of the command from the reader/writer device 2. When it is set to a stop state, the contactless identification tag 3 does not respond upon receiving this command from the reader/writer device 2.

If the contactless identification tag 3 is removed from the commercial product 4, the section to be detected 40 is separated from the main body of the contactless identification tag 3, as described and shown in FIG. 6(*b*). Upon receiving a response request signal from the reader/writer device 2 in this state, the contactless identification tag 3 generates a driving power from the carrier wave of the signal at the power generation section 38 as described above, and distributes the same to the respective sections of the contactless identification tag 3. Then, the voltage monitoring section 34, which is supplied with the electrical power, detects a change in the voltage value $E_1$, and notifies the data control section 32 of this event.

The data control section 32, upon receiving the notification, judges that the contactless identification tag 3 is in a state in which it is removed from the commercial product 4, and transmits a command to the display processing section 36 to have the electrophoretic display device 37 display information indicating that there was an access from the reader/writer device 2. Contents that may be displayed at this time may be contents concerning the access made to the contactless identification tag 3, such as, packet data, the kind of command, data string of data section of the command, and the like, which are sent from the reader/writer device 2.

Also, when it is detected that the contactless identification tag 3 is removed from the commercial product 4, the contactless identification tag 3 does not respond to the reader/writer device 2 at all by the control of the control section 3*b*.

In the present embodiment, two modes may be enumerated: one in which the contactless identification tag 3 is collected and reused, and the other in which it is disposed of and not reused.

If they are to be collected and reused, a sales person may remove the contactless identification tags at the time of sales and collect them. Then, the contactless identification tags 3 are returned to the factory for reuse.

If they are to be disposed, consumers may discard the contactless identification tags 3, and they are not reused.

Figure 7:
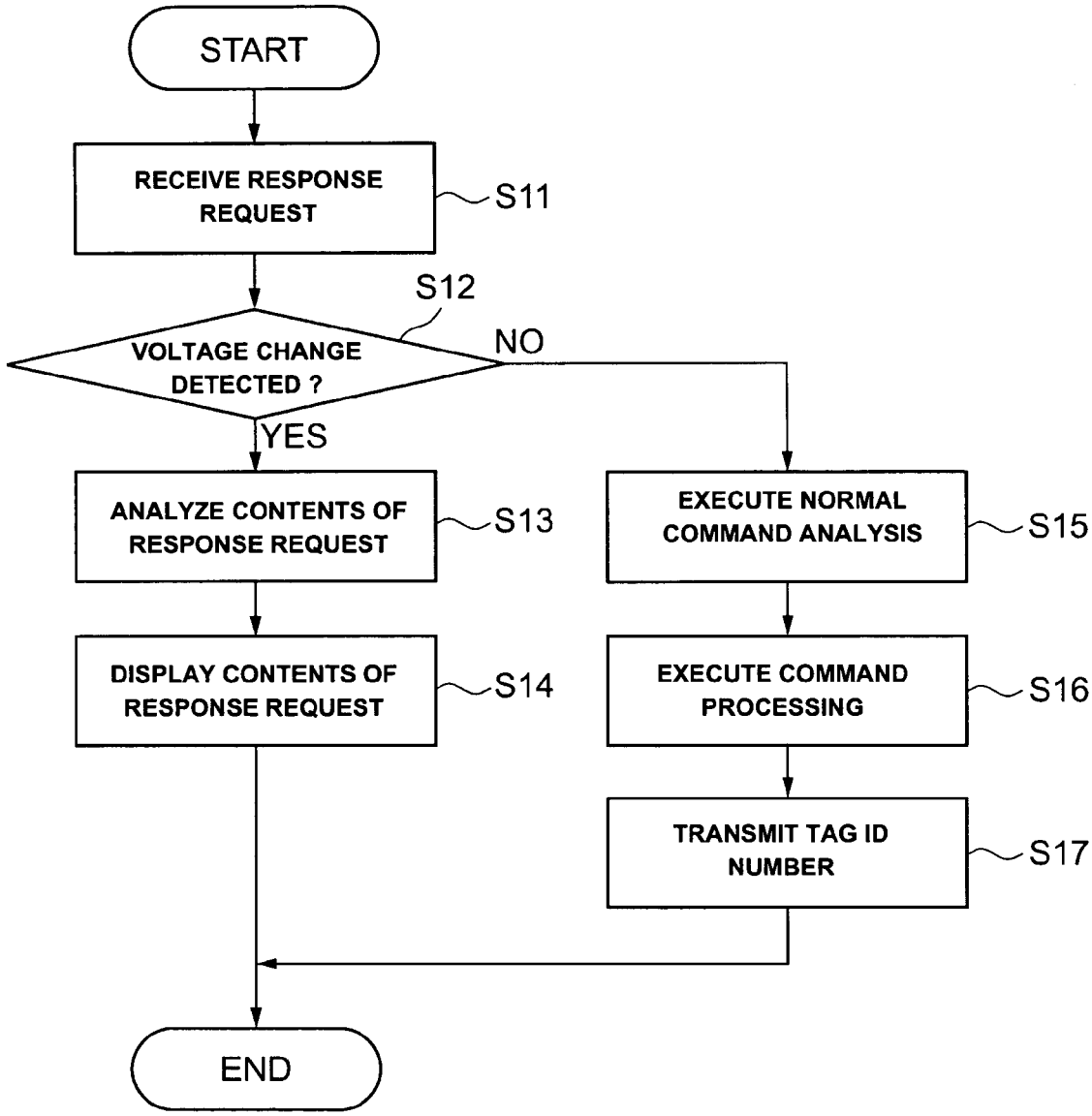
FIG. 7 is a flow chart indicating a process of responding to a request response command conducted by a contactless identification tag.

FIG. 7 is a flow chart indicating a process of responding to a request response command conducted by the contactless identification tag 3.

In step S11, a response request command is received from the reader/writer device 2 through the data reception section 30.

In step S12, it is judged as to whether the voltage monitoring section 34 detects a change in the voltage value $E_1$. When it is judged that it is detected (when it is judged that the section to be detected 40 is removed from the contactless identification tag 3), the process proceeds to step S13; and when it is not detected, the process proceeds to step S15.

In step S13, the control section 3*b* analyzes contents of the response request sent from the reader/writer device 2.

In step S14, the display processing section 36 displays the analyzed content of the response request on the electrophoretic display device 37, and the process ends. In this case (when it is judged that the section to be detected 40 is removed from the contactless identification tag 3), the contactless identification tag 3 does not respond to the reader/writer device 2 at all. Accordingly, the contactless identification tag 3 can be prevented from leaking its information, and its security can be enhanced. It is noted that a record of the access gained from the reader/writer device 2 to the contactless identification tag 3 is stored in the data storage section 33.

In step S15, the control section 3*b* analyzes the response request command sent from the reader/writer device 2.

In step S16, the data control section 32 executes a command processing according to the content of the command analysis.

In step S17, the contactless identification tag 3 transmits its ID number through the data transmission section 31 to the reader/writer device 2, and the process ends.

In accordance with the present embodiment described above in detail, the following effects can be obtained.

The contactless identification tag 3 is made such that the contactless identification tag 3 does not respond to an access from the reader/writer device 2 after the section to be detected 40 has been removed. Therefore, even when an unauthorized access is made to the contactless identification tag 3, the contactless identification tag 3 can prohibit itself from transmitting the information stored in the contactless identification tag 3 to the reader/writer device 2. Accordingly, the contactless identification tag 3 can enhance its security against unauthorized access.

The contactless identification tag 3 displays on the electrophoretic display device 37 access record concerning accesses made from the reader/writer device 2. Accordingly, when illegally accessed by the reader/writer device 2, the state of the contactless identification tag 3 can be readily visually judged by looking at the display section of the electrophoretic display device 37.

Second Embodiment

A second embodiment of the present invention is described below with reference to FIG. 8.

The contactless identification tag 3 in accordance with the present embodiment does not prohibit its response to the reader/writer device 2 when the section to be detected 40 has been removed, and is different from the first embodiment in that functions that are accessible from the reader/writer device 2 to the contactless identification tag 3 are restricted. It is noted that the structure of the contactless identification tag 3 is the same as the contents described in the first embodiment, and therefore its description is omitted.

Figure 8:
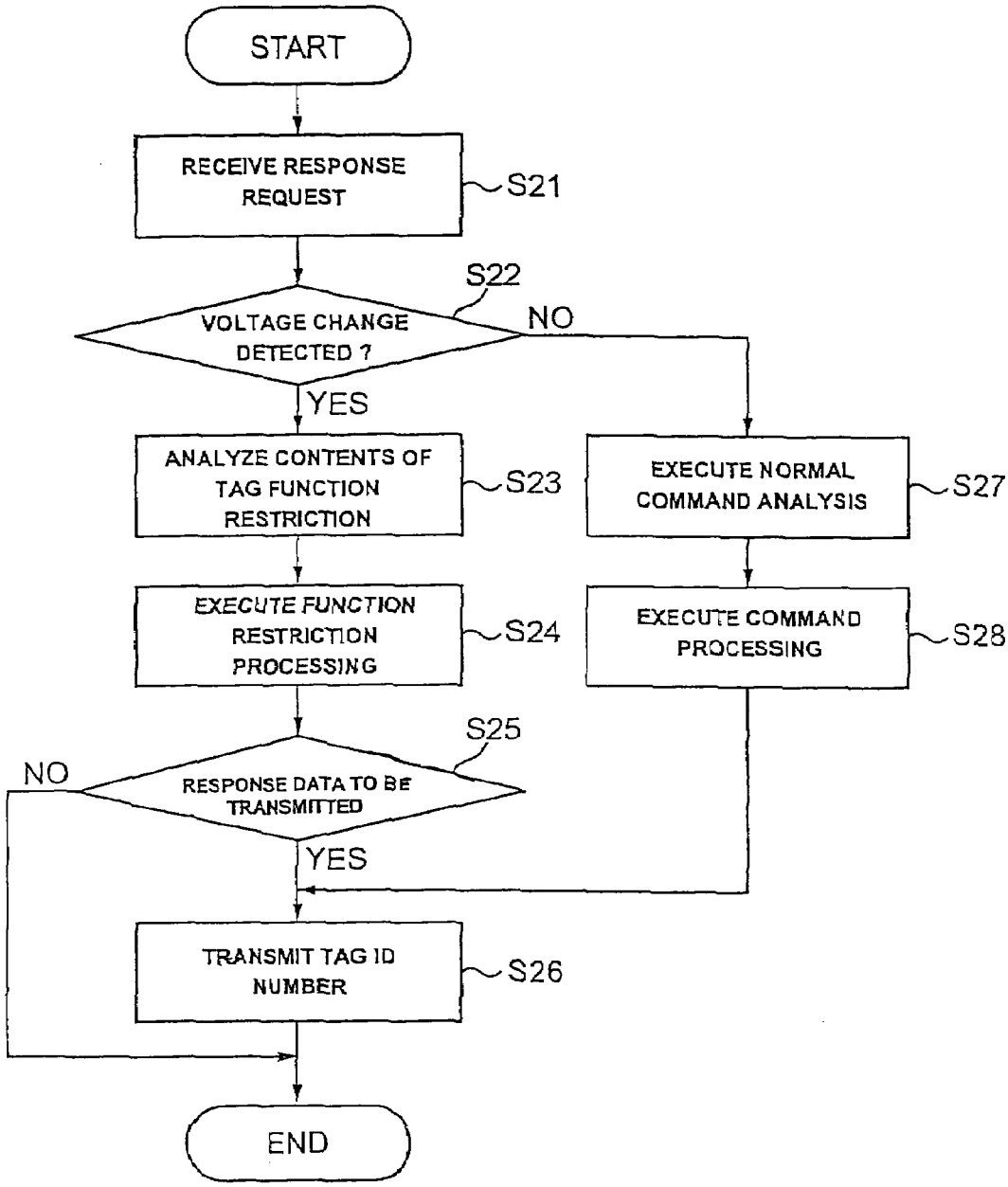
FIG. 8 is a flow chart indicating a process of responding to a request response command conducted by a contactless identification tag in accordance with a second embodiment of the present invention.

FIG. 8 is a flow chart indicating a process of responding to a response request command conducted at the contactless identification tag 3.

In step S21, a response request command is received from the reader/writer device 2 through the data reception section 30.

In step S22, it is judged as to whether the voltage monitoring section 34 detects a change in the voltage value $E_1$. When it is judged that it is detected, the process proceeds to step S23, and the control section 3*b* as a function restriction section executes a process to set restrictions on the functions of the contactless identification tag 3. When it is judged that it is not detected, the process proceeds to step S27.

In step S23, the control section 3*b* analyzes function restriction contents of the functions to be restricted by the contactless identification tag 3 in response to a command from the reader/writer device 2.

Here, the function restriction contents of the contactless identification tag 3 are described.

The contactless identification tag 3 restricts the range of functions that can be executed by the contactless identification tag 3. For example, the contactless identification tag 3 may perform an operation of returning only a part of data to the reader/writer device 2, responding but not returning data, or the like.

Also, the contactless identification tag 3 may perform an operation such that a part of the functions provided in the contactless identification tag 3 cannot be operated (deleting functions), operation of prohibiting writing, operation of prohibiting reading the nonvolatile memory, or the like.

Also, at the time of manufacturing an IC chip of the contactless identification tag 3, its control circuit may be modified, such that the contactless identification tag 3 is equipped with an IC chip on its hardware circuit, which restricts the functions when the sensor operates (when the contactless identification tag 3 is removed). Accordingly, functions to be restricted may differ from one IC chip to another among the contactless identification tags 3.

The contactless identification tag 3 can execute commands normally accessed by the reader/writer device 2. When the detection section confirms that the contactless identification tag 3 has been removed, the contactless identification tag 3 may set a restriction such that the contactless identification tag 3 cannot be accessed, unless a command is transmitted according to a predetermined command transmission procedure. By this, even with commands open to the public, the nonvolatile memory of the contactless identification tag 3 cannot be readily accessed.

Also, during the manufacturing stage of the contactless identification tag 3, the functional restriction may be conducted when the contactless identification tag 3 is removed.

The set contents of the functional restriction of the contactless identification tag 3 are stored in advance in the nonvolatile memory of the data storage section 33. Also, one or a plurality of multiple functional restriction contents that are prepared in advance may be selected by a command that is not open to the public.

In step S24, the data control section 32 executes a process corresponding to the analyzed functional restriction contents.

In step S25, it is judged as to whether data was transmitted in response to the reader/writer device 2 in the process executed in step S24. If data was transmitted, the process proceeds to step S28. If no data was transmitted, the process ends.

In step S26, the data control section 32 transmits an ID number read from the data storage section 33 through the data transmission section 31 to the reader/writer device 2, and the process ends. For example, when a process executed with functional restriction is a data writing process, an ID number may not be transmitted. When it is a data reading process, data read out as well as its ID number are transmitted. This is required for the reader/writer device to confirm the contactless identification tag 3 that is a data transmission source.

In step S27, the control section 3*b* performs a normal command analysis on a response request command from the reader/writer device 2.

In step S28, the data control section 32 executes a process corresponding to the command analysis result. Then, in step S26, an ID number is transmitted to the reader/writer device 2, and the process ends.

According to the present embodiment described above in detail, the following effects can be obtained.

The contactless identification tag 3 restricts functions that can be accessed by the reader/writer device 2, after the section to be detected 40 has been removed. In other words, the contactless identification tag 3 can execute only functions within a restricted range when an unauthorized access is made. Accordingly, the contactless identification tag 3 can prevent its data from being illegally read out, or prevent data from being illegally written in.

Third Embodiment

A third embodiment of the present invention is described below with reference to FIG. 9.

The contactless identification tag 3 in accordance with the present embodiment does not prohibit its response to the reader/writer device 2 or restrict the functions of the contactless identification tag 3 when the section to be detected 40 has been removed, and is different from the first and second embodiments in that functions are added to the contactless identification tag 3. It is noted that the structure of the contactless identification tag 3 is the same as the contents described in the first embodiment, and therefore its description is omitted.

Figure 9:
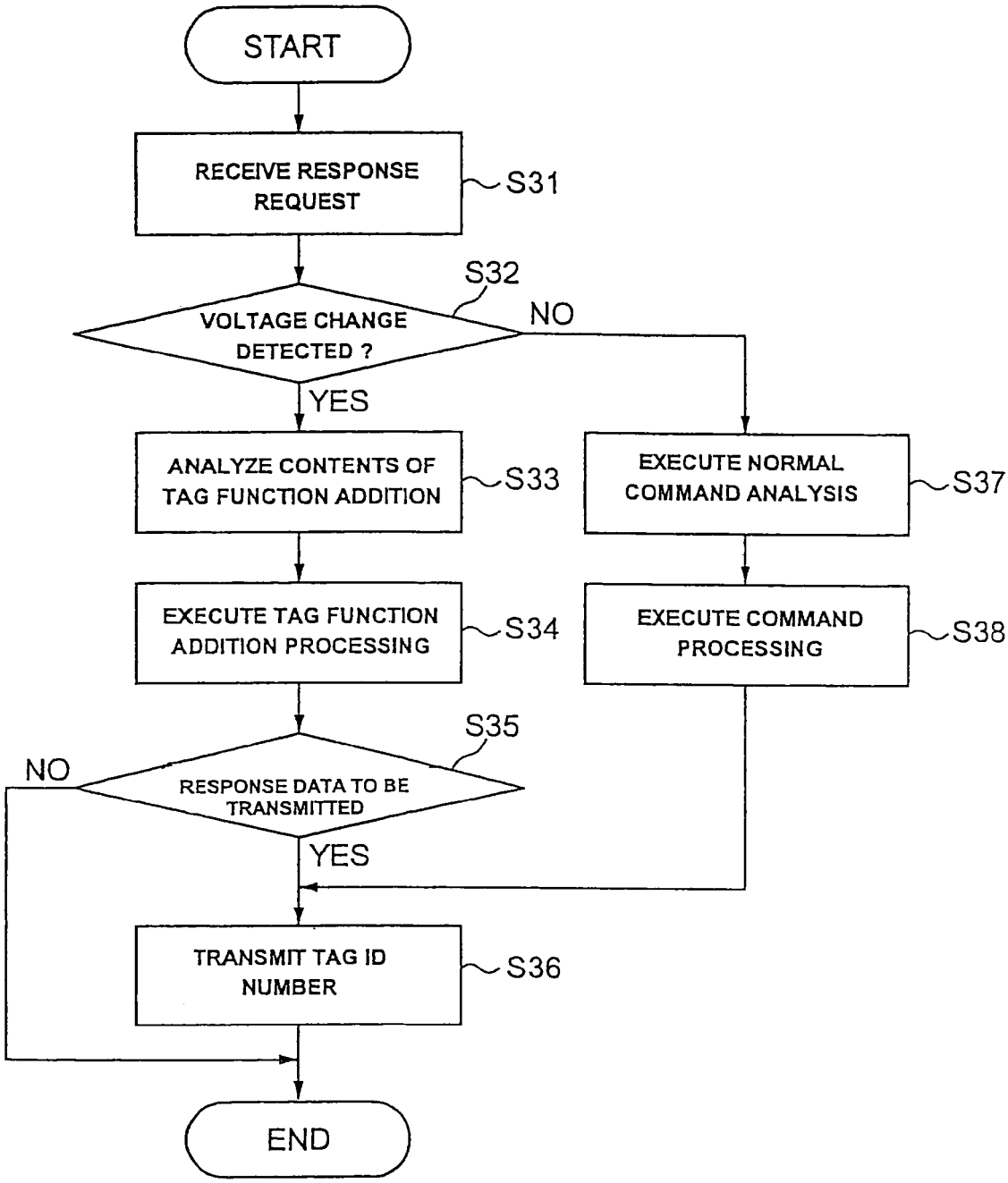
FIG. 9 is a flow chart indicating a process of responding to a request response command conducted by a contactless identification tag in accordance with a third embodiment of the present invention.

FIG. 9 is a flow chart indicating a process of responding to a response request command conducted at the contactless identification tag 3.

In step S31, a response request command is received from the reader/writer device 2 through the data reception section 30.

In step S32, it is judged as to whether the voltage monitoring section 34 detects a change in the voltage value $E_1$. When it is judged that it is detected, the process proceeds to step S33, and when it is judged that it is not detected, the process proceeds to step S37.

In step S33, the control section 3*b* as a function adding section analyzes additional function contents for the contactless identification tag 3 received from the reader/writer device 2. The contactless identification tag 3 is provided with an IC chip that adds functions when the contactless identification tag 3 is removed, and functions to be added to the contactless identification tags 3 may be different depending on IC chips.

Here, the additional function contents of the contactless identification tag 3 are described.

When the section to be detected 40 is removed from the contactless identification tag 3, the contactless identification tag 3 adds a factory examination mode that is used for product examination and maintenance. In the factory examination mode, examination and maintenance are performed to check if data is correctly written in the contactless identification tag 3, the quality of communications is good, and the like. The examination and maintenance are performed in a state in which the section to be detected 40 is removed from the contactless identification tag 3, and the section to be detected 40 is mounted by attaching it to a specified portion of the contactless identification tag 3 when the examination and maintenance are completed, such that the contactless identification tag 3 is reused. Also, when the contactless identification tag 3 uses codes, the control section does not encode or decode them by skipping the encryption circuit.

Furthermore, in the factory examination mode, all of the functions of the contactless identification tag 3 may be set without any restrictions, in order to analyze defects of the same in the market.

Also, the contactless identification tag 3 can be added with a function to permit reception of a command to add functions which is transmitted from reader/writer device 2, a function to change a reading area of the memory and transmit an encryption code or a manufacturer code instead of transmitting an ID number, or the like.

In step S34, the data control section 32 reads data corresponding to the function addition contents from the data storage section 33 and executes the same.

In step S35, it is judged as to whether the data executed in step S34 is data to be transmitted to the reader/writer device 2. If it is data to be transmitted, the process proceeds to step S36, and if it is not data to be transmitted, the process ends.

In step S36, the data control section 32 transmits an ID number read from the data storage section 33 together with the data to be responded and transmitted to the reader/writer device through the data transmission section 31, and the process ends.

In step S37, the control section 3*b* analyzes the response request command sent from the reader/writer device 2.

In step S38, the data control section 32 reads data corresponding to the command from the data storage section 33 and executes the same. Then, in step S36, an ID number is transmitted to the reader/writer device 2, and the process ends.

By the present embodiment described above in detail, the following effects can be obtained.

After the section to be detected 40 is removed, functions that can be accessed from the reader/writer device 2 are added to the contactless identification tag 3. For example, when the contactless identification tag 3 is brought to the factory for recycling in a state in which the section to be detected 40 is removed, it is set in the factory examination mode, and functions that are suitable for examination and maintenance are added. In other words, when examination and maintenance are conducted for the contactless identification tag 3, the contactless identification tag 3 can perform communications without performing troublesome operations such as a command release operation or the like by the reader/writer device 2. Accordingly, accesses can be readily made to the contactless identification tag 3, and maintenance can be readily conducted.

It is noted that, without being limited to the embodiments described above, the following embodiments can be implemented.

MODIFIED EXAMPLE 1

Figure 10:
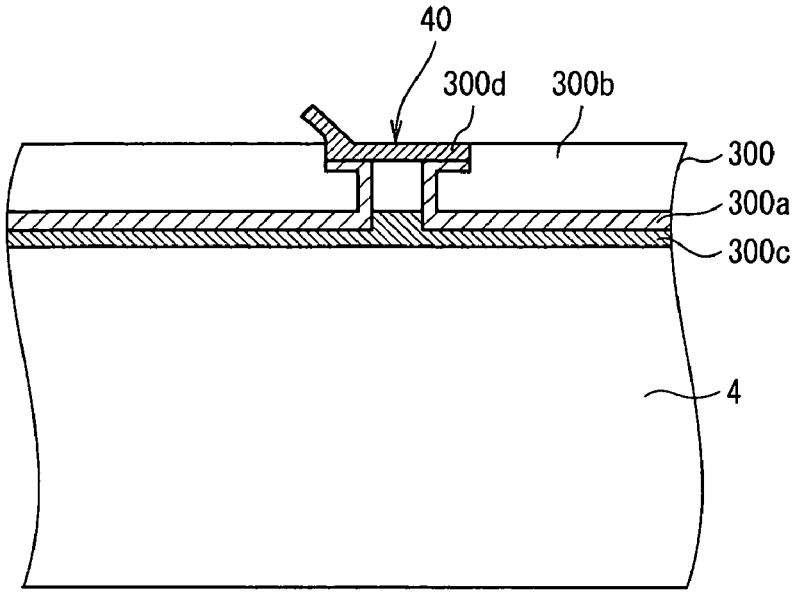
FIGS. 10(*a*) and (*b*) are cross-sectional views indicating a modified example in which a contactless identification tag is attached to a commercial product.
Figure 10:
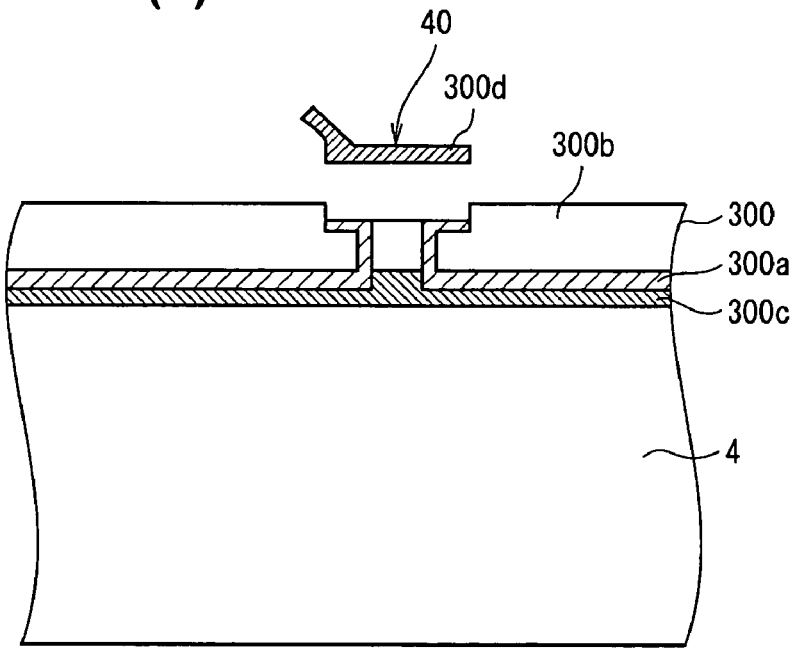

In each of the embodiments described above, the detection section of the contactless identification tag 3 detects the voltage value $E_1$ that is changed as a result of removal of the contactless identification tag 3 from the commercial product 4. However, as shown in FIGS. 10, a portion of the contactless identification tag 3 that is attached to the commercial product 4 may be removed, to change the voltage value $E_1$. FIG. 10(*a*) is a cross-sectional view in which the contactless identification tag 3 is attached to the commercial product 4, and FIG. 10(*b*) is a view indicating a state in which the section to be detected 40 is removed from the contactless identification tag 3 from the state shown in FIG. 10(*a*).

As shown in FIG. 10(*a*), a removal detection circuit section 300 composing the contactless identification tag 3 is attached to the commercial product 4 by an adhesive section 300*c*. In this instance, the section to be detected 40 is formed in a state in which it can be cut off and separated from a wiring 300*a* and a substrate 300*b*. Then, as shown in FIG. 10(*b*), when the section to be detected 40 is removed from the removal detection circuit section 300, because a connecting section of a wiring 300*d* and the wiring 300*a* is formed with a weak bonding force, the section to be detected 40 is cut off from the removal detection circuit section 300, and the removal detection circuit section 300 (the contactless identification tag 3) remains on the commercial product 4.

In this manner, when the section to be detected 40 is removed from the removal detection circuit section 300, the voltage that is divided by the first detection resistance section 35*a* and the second detection resistance section 35*b* would not be voltage-divided, such that the voltage value E1 changes (see FIG. 4). The change in the voltage value is detected by the voltage monitoring section 34, thereby detecting that the first detection resistance section 35*a* is removed from the contactless identification tag 3.

In this modified example, the portions of the contactless identification tags 3 that are attached to commercial products may be removed by sales person, or by consumers. The contactless identification tags 3 that are attached to commercial products may be collected after the commercial products are used by the consumers, for example, through returning the contactless identification tags 3 for refunds to the stores where the commercial products are purchased.

Also, in the case of this modified example, functional restriction and functional addition can be made at any desired time.

MODIFIED EXAMPLE 2

Figure 11:
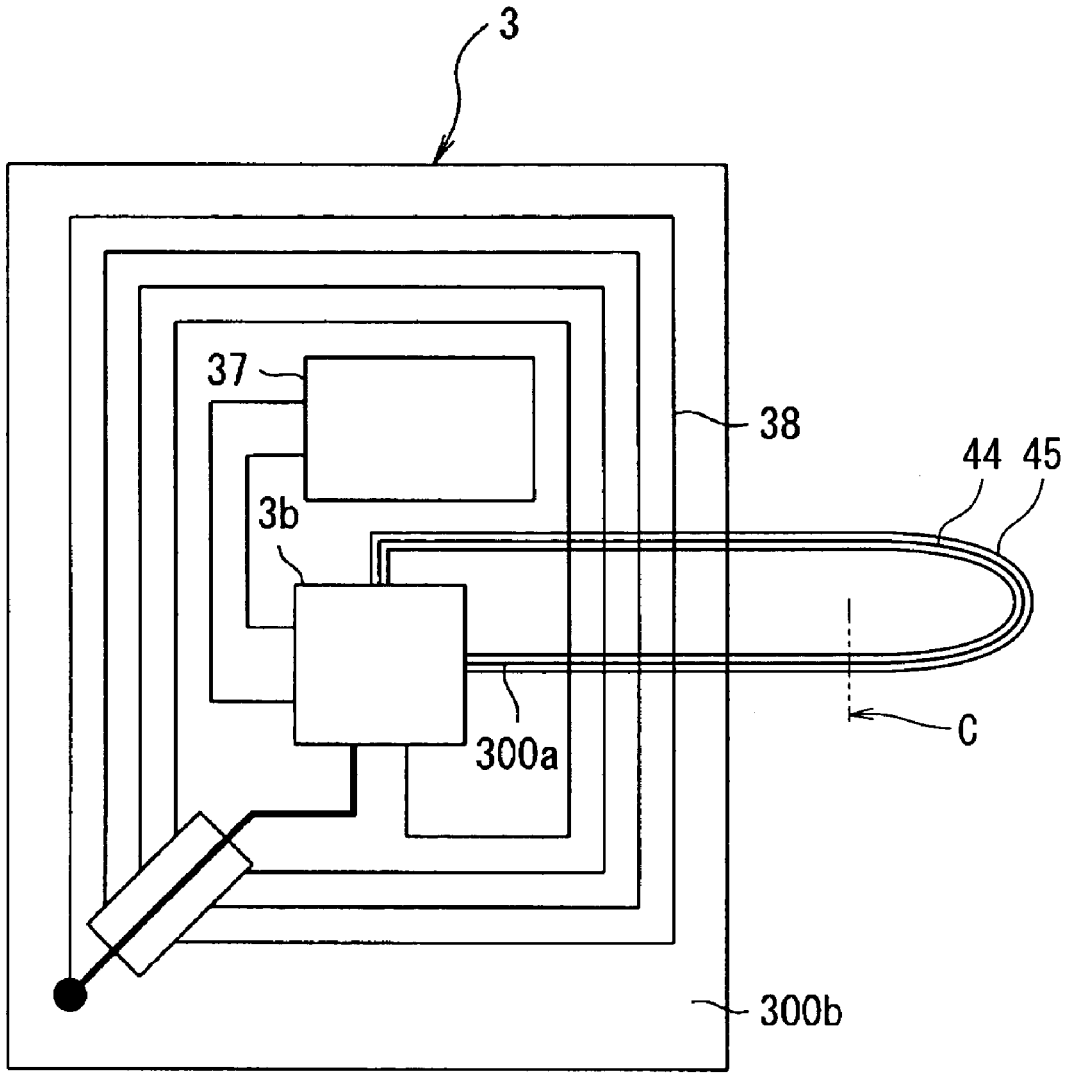
FIG. 11 is a circuit diagram indicating a modified example of a circuit structure of a contactless identification tag.

The detection section in each of the embodiments described above detects the voltage value $E_1$ that is changed as a result of removal of the contactless identification tag 3 from the commercial product 4. However, as shown in FIG. 11, a section to be detected 45 including a first detection resistance section 44 may be extended outside of the substrate 300*b* of the contactless identification tag 3, and a change in the voltage value E1 that is caused as a result of cutting (breaking) the first detection resistance section 44 may be detected. In this case, the first detection resistance section 44 and the wiring 300*a* may be covered by vinyl resin or the like, such that the voltage value $E_1$ would not be changed when their exterior is touched.

Also, the section to be detected 45 can be used as a ring for attaching it to the commercial product 4. For example, the contactless identification tags 3 may be attached by the rings (the section to be detected 45) to the collars of clothing that are sold at stores. When consumers purchase the commercial products, the sales person may cut at sections C of the rings to remove the contactless identification tags 3. Alternatively, consumers may cut them after their purchase.

Also it may be composed such that the first detection resistance section 44 is removed from the contactless identification tag 3 by pulling out the ring (the section to be detected 45).

MODIFIED EXAMPLE 3

Each of the embodiments described above and the modified example 2 are composed such that the first detection resistance section 35*a*, 45 is removed from the contactless identification tag 3 by the action of removing the contactless identification tag 3 from the commercial product 4. However, the contactless identification tag 3 may be provided with a switch, and they can be composed such that functions may be restricted or functions may be added upon detecting an operation of the switch.

MODIFIED EXAMPLE 4

In each of the embodiments described above, the voltage monitoring section 34 detects a change in the voltage value E1 when the contactless identification tag 3 is removed from the commercial product 4. However, instead of removing the contactless identification tag 3, the contactless identification tag 3 may be bent to be deformed, and a change in the voltage value $E_1$ may be detected when the first detection resistance section 35*a* is broken. Also, a sliding switch, a button switch or the like may be provided as a section to be detected, and the first detection resistance section 35*a* may be cut when the switch is operated, such that the voltage value E1 is changed and detected.

MODIFIED EXAMPLE 5

The embodiments described above are described by referring to commercial products 4 to be sold at stores as an example. However, without being limited to the commercial products 4, the embodiments may be applied for improving the security of items that are generally used in commercial distribution systems. Also, the contactless data communication system 1 may be applied for follow-up survey or the like.

What is claimed is:

1. A contactless identification tag, comprising:

a removal detection section including:

a first resistance section including a first wiring, a second wiring, and a detachable section, the detachable section including a third wiring positioned between the first wiring and the second wiring, and the first wiring being configured to be electrically connected to the second wiring via the third wiring; and a second resistance section; and a voltage monitoring section configured to monitor a voltage value between the first resistance section and the second resistance section such that after the detachable section is removed a range of functions of the contactless identification tag is restricted according to the voltage value.

2. The contactless identification tag according to claim 1, further comprising a data control section configured to determine whether the detachable section is removed from the first resistance section.

3. The contactless identification tag according to claim 2, further comprising a data reception section configured to receive a first signal and send the first signal to the data control section, and a data transmission section configured to transmit a second signal.

4. The contactless identification tag according to claim 1, wherein the detachable section further includes an adhesive section.

5. The contactless identification tag according to claim 1, further comprising a data storage section configured to store function restriction data, wherein the function restriction data is used to restrict the range of functions after the detachable section is removed.

6. The contactless identification tag according to claim 1, further comprising a display section configured to display an access communication content when the functions are restricted.

7. The contactless identification tag according to claim 1, further comprising an antenna configured to receive an electromagnetic wave, and a power supply generation section configured to generate an electric power according to the electromagnetic wave and send the electric power to the voltage monitoring section.

8. The contactless identification tag according to claim 7, wherein the voltage monitoring section is configured to detect a change of a voltage of the electric power.

9. The contactless identification tag according to claim 7, wherein the removal detection section is connected to the voltage monitoring section via a wiring.

10. The contactless identification tag according to claim 1, further comprising a power supply generation section configured to generate an electric power according to an electromagnetic wave and send the electric power to the voltage monitoring section, the removal detection section being connected to the voltage monitoring section via a wiring, and the voltage monitoring section being positioned between the removal detection section and the power supply generation section.

11. A contactless data communication system, comprising:

the contactless identification tag according to claim 1; and a reader/writer device including a data communication section that is configured to send a first signal to the contactless identification tag.

12. The contactless data communication system according to claim 11, wherein the reader/writer device includes an electromagnetic wave transmission section that is configured to transmit an electromagnetic wave to the contactless identification tag.

* * * * *